United States Patent [19]

Corey

[11] 4,450,685

[45] May 29, 1984

[54] DYNAMICALLY BALANCED, HYDRAULICALLY DRIVEN COMPRESSOR/PUMP APPARATUS FOR RESONANT FREE PISTON STIRLING ENGINES

[75] Inventor: John A. Corey, North Troy, N.Y.

[73] Assignee: Mechanical Technology Incorporated, Latham, N.Y.

[21] Appl. No.: 384,304

[22] Filed: Jun. 2, 1982

[51] Int. Cl.[3] ..... F02G 1/04

[52] U.S. Cl. ..... 60/520; 60/517; 62/6; 417/383

[58] Field of Search ..... 60/517, 518, 520, 525; 62/6; 417/379, 380, 383, 397

[56] References Cited

U.S. PATENT DOCUMENTS

| | | | |
|---|---|---|---|
| 1,282,145 | 10/1918 | Tobler | 417/383 X |
| 3,604,821 | 9/1971 | Martini | 417/379 X |
| 3,610,214 | 10/1971 | Braun | 417/380 X |
| 4,380,152 | 4/1983 | Folsom et al. | 60/520 |

*Primary Examiner*—Allen M. Ostrager
*Assistant Examiner*—Stephen F. Husar
*Attorney, Agent, or Firm*—Joseph V. Claeys; Arthur N. Trausch, III

[57] ABSTRACT

A compressor, pump, or alternator apparatus is designed for use with a resonant free piston Stirling engine so as to isolate apparatus fluid from the periodically pressurized working fluid of the Stirling engine. The apparatus housing has a first side closed by a power coupling flexible diaphragm (the engine working member) and a second side closed by a flexible diaphragm gas spring. A reciprocally movable piston is disposed in a transverse cylinder in the housing and moves substantially at right angles relative to the flexible diaphragms. An incompressible fluid fills the housing which is divided into two separate chambers by suitable ports. One chamber provides fluid coupling between the power diaphragm of the RFPSE and the piston and the second chamber provides fluid coupling between the gas spring diaphragm and the opposite side of the piston. The working members of a gas compressor, pump, or alternator are driven by the piston. Sealing and wearing parts of the apparatus are mounted at the external ends of the transverse cylinder in a double acting arrangement for accessibility. An annular counterweight is mounted externally of the reciprocally movable piston and is driven by incompressible fluid coupling in a direction opposite to the piston so as to damp out transverse vibrations.

27 Claims, 6 Drawing Figures

DYNAMICALLY BALANCED, HYDRAULICALLY DRIVEN COMPRESSOR/PUMP APPARATUS FOR RESONANT FREE PISTON STIRLING ENGINES

The Government of the United States has rights to this invention pursuant to Contract No. 86X-61618C awarded by the United States Department of Energy.

TECHNICAL FIELD

This invention relates to gas compressors, pumps and other like apparatus suitable for use with Stirling engines as the primary source of driving power and provides a novel dynamically balanced, hydraulic drive for power coupling a load such as a gas compressor, pump, alternator or other similar apparatus to the Stirling engine.

More particularly, the invention relates to a dynamically balanced, hydraulically driven gas compressor power coupled to a resonant free piston Stirling engine through a power coupling flexible diaphragm and suitable for use in heat pump applications under conditions where electricity is neither available or prohibitively expensive and the cost of conventional gasoline or diesel driven electric generator units makes their use impractical.

BACKGROUND PROBLEM

There is a substantial need for gas compressors for use in heat pumps, air conditioners and other like equipment under conditions where electricity is either not available or more expensive to provide than combustible fuel that can be burned in the external combustor of a Stirling heat engine. To meet this need a refrigerant gas compressor driven by a resonant free piston Stirling engine (RFPSE) has been developed. The RFPSE is a linearly oscillating heat engine having an external combustor with high efficiency, durability and low emissions and has been developed by Mechanical Technology Incorporated (MTI), the assignee of the present invention, over a number of years. Previous efforts to couple gas refrigerant compressors to Stirling engines by direct mechanical means, have resulted in identifying a major problem due to the inability to maintain segregation of the refrigerant gas and the Stirling engine working gas. MTI provided one approach to a solution to this problem through the use of a metallic diaphragm as the working member of a Stirilng engine in place of the power piston. Power is transferred from the Stirling engine to the compressor plunger through pressurized hydraulic fluid. In such an arrangement, the power coupling flexible diaphragm provides a hermetic seal between the engine's working gas (helium) and the hydraulic fluid that drives the compressor plunger. With this arrangement, the leakage problem is reduced to preventing mixing of refrigerant gas with the hydraulic fluid. This is not a severe problem since fluorocarbon refrigerant gases do not affect the incompressibility of the hydraulic fluid, even at saturation. The viscosity of the hydraulic fluid is reduced by the refrigerant gas in solution, but this improves transmission efficiency.

The major constraint on the overall system design is the required compatibility of the compressor/pump apparatus with a RFPSE. Such engines are operated in dynamic resonance and the internal masses (displacer and power piston or coupling diaphragm) oscillate against gas springs under the influence of the engine pressure wave. Load in the form of the compressor/- pump apparatus is applied as damping between the power piston (power coupling flexible diaphragm) and ground. It is here that the compressor/pump apparatus must fit. Because of the resonant condition, variation of load causes variation in stroke (resonant amplitude). The compressor/pump apparatus design must accommodate this fact, either by operating as a variable-stroke machine or by converting the stroke variable to speed modulation. To avoid conversion losses and allow directly-coupled power transmission, the variable stroke concept has been embodied in the present invention.

Because the RFPSE is a closed cycle engine, contaminants are not discharged with each stroke of the piston in the same manner as an internal combustion gasoline or diesel driven engine. Instead, the contaminants build up in the contained working fluid over the life of the engine and tend to degrade performance. For successful long term operation of an RFPSE driven heat pump, air conditioner or other like apparatus, complete isolation of the contaminants (including refrigerant gas) from the Stirling engine's working gas (helium) must be maintained. In the present invention this has been accomplished by replacing the sliding power piston with a sealed metallic flexible power coupling diaphragm that deflects elastically. This diaphragm provides hermetic sealing between the Stirling engine end of the combined assembly and the compressor/pump apparatus driven by the engine. In such an arrangement, hydraulic power output is required as the flexible diaphragm can support only pressure, not localized mechanical loading. The moving mass of incompressible hydraulic fluid (oil) then becomes a part of the flexible diaphragm (power piston) mass. In such designs, the power piston gas spring (charged with helium) is dynamically connected to and mechanically isolated from the oil piston by means of a second, flexible gas spring diaphragm. Output power in the form of refrigerant gas compression, etc., is extracted from the oscillating hydraulic oil by interposing the compressor/pump apparatus drive piston in the hydraulic fluid coupling flow path.

Earlier known designs for systems having the above briefly discussed characteristic, have stacked components in a coaxial assembly. Such system designs typically have been very long, causing mounting difficulties and preventing installation in conventional sized housing cabinets. In addition, and more importantly, the compressor/pump components necessarily had to be embedded within the hydraulic drive assembly components thereby making assembly of the overall compressor/ pump and hydraulic drive assembly as well as service to the system after assembly, both difficult and expensive. A compressor concept has been developed, as shown for example by copending application, Serial No. 384,303 by Mike Walsh entitled, "Linear Hydraulic Drive System for a Stirling Engine," filed concurrently in which the oilflow path is folded by rotating the compressor axis 90° with respect to the engine axis. This compressor concept is more compact, lighter, and more accessible.

However, the sideway motion of the orthogonally mounted compressor piston may cause a new mode of vibration. In previous known in-line compressor systems, all vibration was axial. The transverse piston introduces a rocking moment about the systems center of mass, and puts loads on the engine displacer bearings and combustor assembly, for example. These combined loads produce significantly more vibration than simple axial vibration. A balancing system is required to eliminate the problem by minimizing the compressor's transverse contribution. To overcome these difficulties, the present invention was devised.

SUMMARY OF THE INVENTION

It is therefore a primary object of the invention to provide a new and improved compressor/pump apparatus having a novel dynamically balanced, hydraulic drive assembly which is compact, lighweight, readily assembled with fewer components than prior art devices of the same type and which can be mounted in a dynamically balanced, driven relationship on a resonant free piston Stirling engine so as to provide easy access to the compressor/pump apparatus component parts for ready assembly and servicing.

In practicing the invention, a novel dynamically balanced, hydraulically driven apparatus for use with resonant free piston Stirling engines and their method of operation, are provided. The novel apparatus comprises a housing having a first side closed by a power coupling flexible diaphragm driven by a free resonant piston Stirling engine and a second side opposite the first side closed by a second flexible diaphragm that comprises part of a gas spring. The housing has a central bore therein which forms a cylinder that extends transversely to the axial direction of flexure of the flexible diaphragms. A reciprocally movable piston is slidably seated in the cylinder. An incompressible hydraulic fluid fills a space within the housing surrounding a portion of the cylinder which space is divided into two separate chambers. The first chamber provides incompressible hydraulic fluid coupling between the power coupling flexible diaphragm driven by the RFPSE and one side of the reciprocally movable piston and the second chamber provides incompressible hydraulic fluid coupling between the second gas spring flexible diaphragm and the remaining opposite side of the reciprocally movable piston. At least one working member of a compressor, pump, alternator or other like apparatus is connected to and reciprocally driven within the cylinder by the reciprocally movable piston. The method of operation and assembly is such that the reciprocally movable piston and its interconnected working member is driven in a first direction within the cylinder via the incompressible fluid coupling upon flexure of the RFPSE driven power coupling flexible diaphragm in a second direction which is at substantially right angles to the first direction of movement of the reciprocally movable piston. This causes flexure of the gas spring flexible diaphragm in the same second direction due to incompressible fluid coupling in the second chamber and the movement of the reciprocally movable piston initiated by the RFPSE drive. The RFPSE driven and gas spring flexible diaphragm are returned in a direction opposite to the second direction back toward the center position of the diaphragms and beyond by spring return action induced by their flexure upon the cyclical reduction in pressure of the periodic pressure wave produced by the RFPSE. This results in driving the reciprocally movable piston and its interconnected working members via incompressible fluid coupling in the second and first chambers back in a direction opposite to the first direction to thereby reciprocate the movable piston and its interconnected working members within the cylinder at the same frequency as the frequency of the periodic pressure wave produced by the RFPSE but along an axial direction of movement which is substantially at right angles to the axial direction of the applied force developed by the periodic pressure wave produced by the RFPSE.

In preferred forms of the invention, dynamic balancing is achieved by an annular counterweight supported within the cylinder and surrounding the reciprocally movable piston for counterbalancing vibrations produced by reciprocation of the reciprocally movable piston. The apparatus preferably is double acting and has working members formed on either side of the reciprocally movable piston for movement within the cylinder to produce output work during each stroke of the reciprocally movable piston. The annular counterweight member is driven by incompressible fluid coupling acting on opposite ends of the counterweight either directly or via one or more additional chambers filled with an incompressible fluid and further compartmentalized within the cylinder. In such arrangements the pressure of the incompressible fluid in the several chambers is equalized at substantially the mid-stroke positions of the reciprocally movable piston and counterweight. Further, the reciprocally movable piston with the interconnected working member of the apparatus and the counterweight effectively are centered within the cylinder over long inactive periods by quasi-static, mechanical centering springs effectively acting on the reciprocally movable piston and counterweight to keep them near their initial at-rest position.

In the most preferred embodiment of the invention, the incompressible fluid pressure produced by the flexure of the power coupling flexible diaphragm of the RFPSE acts directly on the annular counterweight member to cause the incompressible fluid in the oppositely acting, additional fixed volume spaces to indirectly drive the reciprocally movable piston in one direction. The incompressible fluid pressure induced by return spring action of the second flexible gas spring diaphragm acts directly on the annular counterweight member in the opposite direction to cause the incompressible fluid in the oppositely acting, additional fixed volume spaces to indirectly drive the reciprocally movable piston in the opposite return direction.

In another embodiment of the invention, the incompressible fluid pressure produced by flexure of the power coupling flexible diaphragm of the RFPSE, acts directly on one side of the reciprocally movable piston to move it in a first direction and movement of the reciprocally movable piston acts through the incompressible fluid trapped in an additional fixed volume space to drive the annular counterweight member in the opposite direction of movement. The fluid pressure of the incompressible fluid produced by the return spring action of the second flexible gas spring diaphragm acts directly on the opposite side of the reciprocally movable piston to return the piston in the opposite direction and the return movement of the reciprocally movable piston acts through the incompressible fluid pressure induced in an additional fixed volume space to drive the annular counterweight member back in the opposite direction during each cycle of operation of the apparatus.

BRIEF DESCRIPTION OF DRAWINGS

These and other objects, features and many of the attendant advantages of this invention will become better understood upon a reading of the following detailed description when considered in connection with the accompanying drawings, wherein like parts in each of the several figures are identified by the same reference character; and wherein.

BEST MODE OF PRACTICING INVENTION

Figure 1:
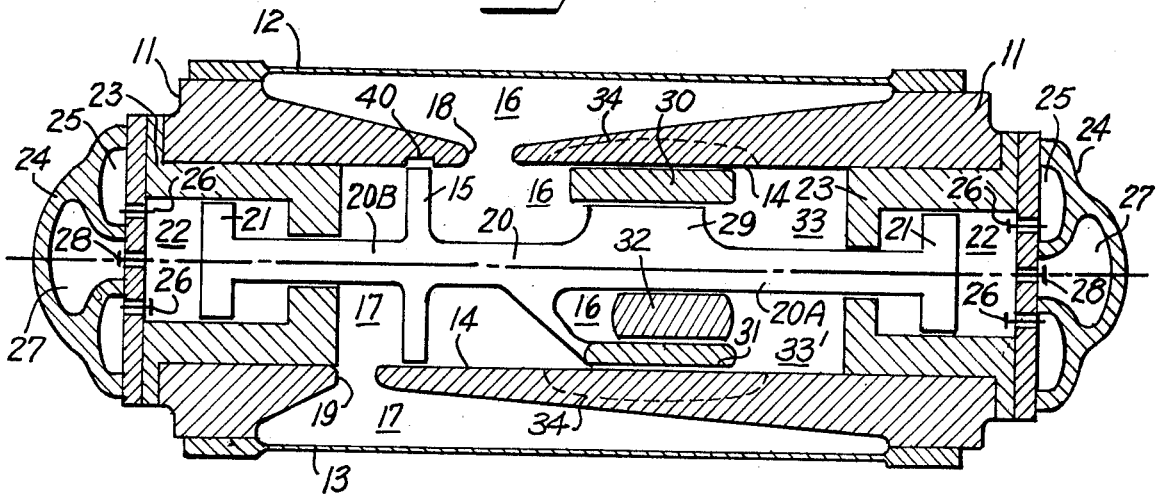
FIG. 1 is a schematic, longitudinal sectional view of a novel, dynamically balanced, hydraulically driven compressor/pump apparatus for use with resonant free piston Stirling engines, constructed according to the invention and illustrates two different constructions for the counterweight balancing of undesired vibrations of the apparatus.

FIG. 1 is a longitudinal sectional view of a novel, dynamically balanced, hydraulically driven gas compressor/pump apparatus for use with resonant free piston Stirling engines. As shown in FIG. 1, the apparatus is comprised by a housing 11 having a first side closed by a first, power couping flexible diaphragm 12 which may comprise the working member of a resonant free piston Stirling engine (RFPSE) as will be described more fully hereafter with respect to FIG. 4 of the drawings. Housing 11 has a second open side closed by a second flexible diaphragm 13 which is diametrically opposite the first flexible diaphragm 12, and which comprises a part of a gas spring (not shown in FIG. 1). For this purpose, the area below the second flexible diaphragm 13 would enclose a bounce space so that a compressible gas could be contained therein as will be described hereafter with relation to FIGS. 2 and 4 of the drawings. The housing 11 may be cast from iron, steel, aluminum, or other like material and has a central bore or cyliner 14 extending transversely therethrough substantially at right angles to the axial direction of movement of the flexible diaphragms 12 and 13 during flexure. Into this bore a reciprocally movable piston 15 is fitted which divides the internal volume of the cylinder 14 into two parts or spaces 16 and 17, respectively. The first space 16 communicates through a first port 18 through the side of cylinder 14 so as to provide fluid communication between one side of the first flexible diaphragm 12 and a first side of the reciprocally movable piston 15. The second space 17 communicates through a port 19, which is offset along the axial length of cylinder 14 from the first port 18, with the space 17 exposed to one surface of the second gas spring diaphragm 13 thereby providing a fluid coupling path between the second gas spring flexible diaphragm 13 and the remaining opposite surface of the reciprocally movable piston 15. Piston 15 is disposed axially along the length of cylinder 14 in the space between the two offset ports 18 and 19. The spaces 16 and 17 are filled with an incompressible hydraulic fluid (oil) which serves to transmit force and motion between the flexible diaphragms 12 and 13 and the reciprocally movable piston 15.

The reciprocally movable piston 15 is secured intermediate to the length of a shaft member 20 having first and second shaft portions 20A and 20B extending on opposite sides of the piston 15 and coaxially movable within cylinder 14 along with piston 15. Attached to each end of the shaft portions 20A and 20B is the working member of a gas compressor, pump, or other similar apparatus. In FIG. 1, the working members comprise gas compressor pistons 21 which are secured to each end of the shaft portions 20A and 20B with the shaft portions 20A and 20B passing through suitable seals formed at the end of the cross bore or cylinder 14. The seals are formed by a reduced diameter opening in the bottom of a cup-shaped flanged cylinder liner 23 which fits over and closes the ends of the cross bore cylinder 14 to define working cylinders for the gas compressor pistons 21. The flanged cup-shaped cylinder liners 23 are closed by a plenum assembly 24 having inlet plenums 25 communicating with the compression space 22 between the ends of the gas compressor piston 21 and the bottom plate of the plenum assembly 24 through suitable inlet valves 26 and a discharge plenum 27 communicating with the compression space 22 through discharge valves 28.

In operation, the resonant free piston Stirling engine (RFPSE) mounted on top of the first flexible diaphragm 12 will operate in the normal manner to produce a periodic pressure wave that acts on a first power coupling flexible diaphragm 12 to cause it to flex inwardly. Inward flexing of diaphragm 12 produces a pressure wave in the incompressible fluid (hydraulic oil) in space 16 causing it to move piston 15 to the left from the position shown. This in turn produces a pressure wave in the oil in space 17 and causes it to flex the gas spring flexible diaphragm 13 downwardly in the same axial direction of movement as the flexure of the power coupling first diaphragm 12. It will be noted, however, that movement of the piston 15 is substantially at right angles to the axial direction of movement of the first and second flexible diaphgrams 12 and 13. As the periodic pressure wave cyclically reduces in pressure in the normal manner of a Stirlng engine, the compressed gas in the gas spring volume enclosed below the second gas spring flexible diaphragm 13 causes diaphragm 13 to be returned through spring action back toward the center position. This action in turn produces a pressure wave in the oil in space 17 causing piston 15 to be moved back toward the center position of the diaphragm and beyond. This movement of the piston 15 in turn then produces a pressure wave in the oil in space 16 causing power coupling diaphragm 12 to be returned in a sinusoidal manner back to its center position in conjunction with the normal spring action built into the power coupling first flexible diaphragm 12. The result of this repeated sequence of actions is a reciprocal movement of the piston 15 within cylinder 14 at the same frequency as the frequency of the periodic pressure wave produced by the RFPSE. The gas compressor pistons 21 simultaneously operate as compressor pistons in the conventional manner, alternately compressing, expelling and ingesting gas in the compression spaces 22.

From the above brief description of FIG. 1, it will be appreciated that the invention provides an arrangement whereby there is a folding of the incompressible hydraulic oil-flow path achieved by rotating the compressor axis substantially 90° with respect to the RFPSE axis. The hydraulic oil acts either directly or indirectly on either side of the transverse piston 15 in the same manner as it did on axial ones. Power is extracted by the power coupling diaphragm from the periodic pressure wave of the RFPSE and deliveries to the compressor at an orthogonal angle through the hydraulic fluid which provides a curved force displacement transfer path between the two components. The effect achieved is to greatly reduce the length of the overall RFPSE and compressor assembly, and does so without any increase in overall width (which is controlled by the power coupling flexible diaphragm diameter). Most importantly, however, is the location of the compressor heads including the inlet and discharge plenums, valves and compressor pistons and cylinders in a readily acccessible exterior location where they can be serviced and changed if necessary without having to disassemble or otherwise affect the hydraulic drive subsystem. This makes initial fabrication and assembly as well as subsequent servicing much less complex, and cheaper than otherwise possible with prior known designs.

As previously noted, the lateral motion of the transverse pistons causes a new mode of vibration in the overall assembly, however, which was not present with previous in-line compressors (or engines alone) wherein all vibrations were axial only. The transverse piston movement introduces a rocking moment about the system's center of mass. This transverse vibratory mode, in addition to noise (60 Hertz hum), puts unacceptable loads on the displacer bearings and the combustor assembly and makes design of the system significantly more difficult in comparison to the simple axial vibration encountered with the earlier know designs. To overcome this difficulty, a balancing system is required to eliminate the problem by minimizing the compressor's vibratory contribution.

A balancing system is provided to the apparatus of FIG. 1 by a balance mechanism which is mounted within the cross bore 14 but to one side of the main piston 15 and the oil ports 18 and 19. This balance mechanism may comprise either one of two forms. The first form of balance mechanism is illustrated on the upper side of shaft 20 and comprises an enlargement 29 in the cross sectional area of the main piston shaft 20 and a concentric, annular weight 30 which surrounds the enlarged shaft portion 29 and is sized to occupy the remainder of the area in the cross bore. The alternative form of balance mechanism is shown on the lower side of shaft 20 and comprises an annulus 31 secured to the main shaft 20 and defining a space within which an annular weight 32 is disposed.

With either form of balance mechanism shown in FIG. 1, the space shown at 33 and 33′ is constrained by the incompressibility of the hydraulic oil to be a constant volume space. Consequently, upon the main piston assembly 15 moving into that volume (rightward as shown in FIG. 1), the balance weight 30 (32) is forced out (leftward as shown in FIG. 1). This counter-motion effects the balancing action as the masses of the piston 15 and shaft 20 and the weight 30 (32) are sized such that the product of the piston mass and stroke equals the product of the counterweight mass and stroke. As the piston and weight necessarily displace the same volume from the sides thereof exposed to constant volumetric space 33 or 33′ similarly they do not disturb the volume in the spaces 16. Thus, it will be appreciated that by its design, the annular counterweight minimizes complexity and at the same time effectively reduces to a minimum transverse vibrations produced by the apparatus. The single transverse bore in the housing of the apparatus is made clear through so that the main drive piston, the counterweight and flanged cup-shaped compressor cylinder liner or sleeve slide in, and the compressor pistons and plenums cap the assembly thereby making initial construction relatively easy and low in cost. This same feature makes servicing of the assembly after it has been in operation much simpler and cost effective than with prior designs.

In addition to the above feature, if desired, an alternator can be fitted into the compressor/pump apparatus housing by providing space for stator windings in the area denoted by dotted outline 34 in FIG. 1. The plunger then could comprise a permanent magnet which would be part of either the counterweight or the piston shaft depending upon the scheme chose for counterbalancing the assembly.

Figure 2:
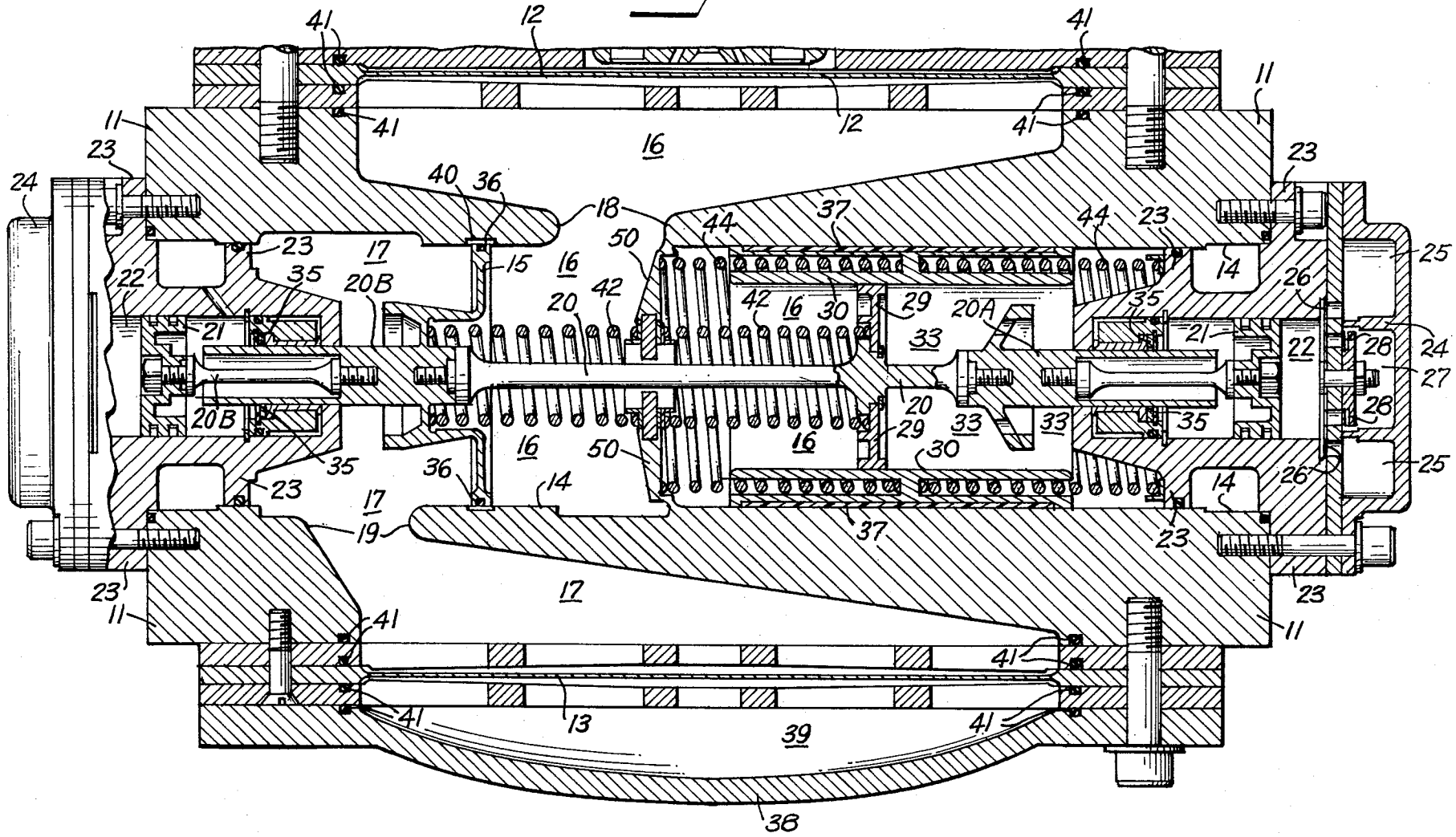
FIG. 2 is a longitudinal sectional view of an actual physical construction of the dynamically balanced, hydraulically driven compressor/pump apparatus for use with RFPSE shown schematically in FIG. 1.

FIG. 2 is a longitudinal sectional view of the detailed construction of a dynamically balanced, hydraulically driven, RFPSE powered gas compressor constructed in accordance with the features of construction illustrated schematically in FIG. 1 of the drawings. In FIG. 2, like parts of the compressor have been identified by the same reference numeral, and hence with the exceptions of the need for description of a few additional parts and features a detailed description of its construction and operation is believed unnecessary. In FIG. 2, the flanged liner or sleeve 23 is shaped somewhat more complexly and differently than its counterpart in FIG. 1 and is fitted over each of the opposite ends of the through bore 14 formed in cast housing 11, and is secured thereto by suitable bolts. The gas compressor plenum 24 including the inlet and discharge plenums 25 and 27 and their associated inlet and outlet valves 26 and 28 to the compression spaces 22 are in turn attached over the flanged liner 23 by the same through bolts. The flanged liner 23 has formed therein the cylinders 23A in which the gas compressor piston 21 reciprocates to sequentially ingest, compress and discharge compressed gas from the inlet plenums 25 to the discharge plenum 27 comprising a part of the compressor plenum assembly 24. The compressor pistons 21 are connected to and reciprocate with the extensions 20A and 20B of main shaft 20 driven by the reciprocally movable main piston member 15. Conventional piston rings fitted to the compressor pistons 21 in conjunction with high differential pressure seals 35 provide isolation between the gas compressor fluid (freon) and the hydraulic oil used to drive reciprocally movable, hydraulically driven piston 15 from gas compression space 22. To assure separation of the first and second or chambers 16 and 17, a suitable seal arrangement 36 to be described hereafter with relation to FIG. 5 surrounds the periphery of the radial extent of bore 14 in which the reciprocally movable, hydraulically driven piston 15 moves.

In the embodiment of the invention shown in FIG. 2, it will be seen that the alternative construction of employing an enlarged diameter portion 29 of shaft 20 is employed to form a second reciprocally movable piston member that reciprocates right and left with the main piston member 15 due to interconnection through the main shaft 20. This second piston member defines one side of the constant volumetric space chamber 33 which is exposed to one side of the oppositely-reciprocating counterweight 30 as described previously with relation to FIG. 1 of the drawings.

Lastly, it will be seen that a dome-shaped cap 38 is secured over the second flexible gas spring diaphragm 13 to define an enclosed space 39 which is filled with a suitable gas (helium) to form the gas spring volume that acts in conjunction with the diaphragm 13 to cause it to return back in the direction to and through its normal, center position following each periodic pressure pulse interval of the RFPSE driving the assembly. This dome-shaped cap is secured to housing 11 via suitable machine screws and seals indicated at 41 which also are provided between the flexible diaphragms 12 and 13 to avoid leakage around these parts.

From a consideration of FIG. 2 it will be appreciated that the use of the annular counterweight design minimizes complexity of the parts as well as assembly of the compressor. The single bore 14 in casting 11 is made clear through so that the main reciprocally movable piston 15, the counterweight 30, cylinder lining 34 together with the compressor cylinder 23 and piston 21 and their interconnecting shaft members 20A and 20B all can be slid in and then capped by the plenum assembly 24. This makes initial construction and assembly and subsequent servicing of the compressor apparatus much simpler and less expensive than is true of previously known in-line designs as discussed earlier.

Figure 5:
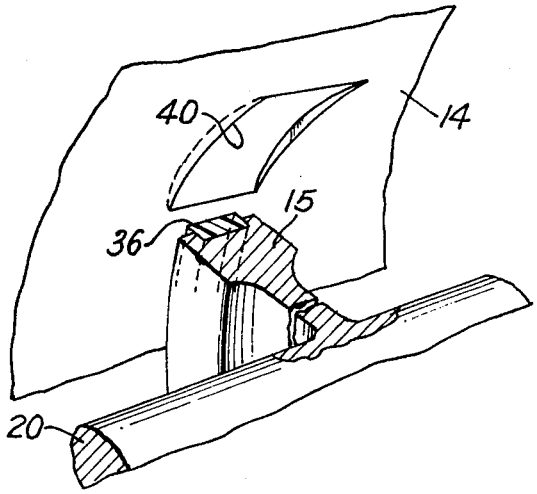
FIG. 5 is a partial perspective view of the interior of the apparatus showing the construction of a mid-stroke centering porting feature for equalizing the mid-stroke hydraulic oil pressures in volumetric spaces filled with hydraulic oil.

The hydraulic drive sub-system implies a lack of positive location for the reciprocating main drive piston 15 and counterweight 30. It is possible for preferential leakage across the seals 36 and 37 to occur. If such preferential leakage does occur, the net change in oil volumes will cause a drifting off-center of the piston and counterweight. That is, the equal pressure point in each cycle (when there is no differential pressure across the piston 15), will occur at other than the mid-stroke point. To correct this problem, centering ports are formed at radially spaced apart points adjacent the seals 36 and 37. For example, there may be three such centering points spaced apart 120° radially around the seals 36 which would have a construction such as that shown in FIG. 5 of the drawings. In FIG. 5, it will be seen that at its normal at rest, mid-stroke position the main reciprocally movable piston member 15 and attached seal 36 are centered over a port 40 formed in the side of cylinder 14 and having any axial extent w. This port is nothing more than a small slot which is slightly longer than the seal 36 axial length so that at, or very near to, the mid-stroke point, the seal is short circuited by a fluid path. Should the pressure across the piston 15 not be balanced at the mid-stroke position, corrective flow will occur through the port 40 thereby balancing the hydraulic fluid (oil) pressure in the volumes on either side of piston member 15. Since there are three such ports 40 spaced 120° radially around the inner circumference of the cylinder wall 14, mid-stroke equalization of the fluid pressure can take place rather rapidly during each reciprocation of piston member 15.

The mid-stroke porting system has proven very effective for dynamic centering both in gas bearings and with hydraulic systems. However, during periods of shutdown, it is possible for a non-level machine to experience piston drift by slow seal leakage. If the drift is sufficiently severe, the stroke of the unit when started may not even cross the mid-stroke centering port. If this occurs, then no corrective flow can occur as described above. In the extreme case, the piston could drift to its stop, effectively locking the unit from further movement at all.

In order to overcome the quasi-static drift problem described in the preceeding paragraph in a cost-effective manner, mechanical centering springs shown at 42, are provided which act between the main drive piston 15 and the second, auxillary piston 29 that coacts with counterweight 30 to define the closed volume chambers 33 and the inner periphery of a mechanical spring support member 50 secured to casing 11. Additional centering springs 44 are provided which act upon counterweight 30 between the outer periphery of the spring support member 50 and an internal surface of the flange sleeve or liner 23. The mechanical centering springs 42 and 44 act on both sides of the reciprocating elements. The stiffness of these springs is required to be sufficient to hold fully leak-relaxed pistons and/or counterweight 30 to within one quarter of the full stroke amplitude upon the compressor apparatus being oriented such that the pistons are upright and there is no support from surrounding oil for the pistons. This assures that upon being started, the pistons can and will cross over the center ports, and that at full-stroke in the maximum off-center condition, that the pistons would just touch the stops on the nearer side.

The use of mechanical springs with a minimum required stiffness creates a potential fatigue failure problem. One form of the compressor is designed to run at about 60 Hertz, so that any mechanical springs such as 42 and 44 being driven by the unit must have an effective infinite cyclic life. The geometry of the compressor apparatus determines where the mechanical springs can fit, leaving stroke as the only free variable in the spring loading. To assure satisfactory spring life, the compressor stroke is limited to about 20 millimeters. The actual maximum design stroke is about 19 millimeters (0.75 inches). With the fixing of the stroke of the of the main drive piston, the displaced volumes of diaphragms and compression spaces set the outer diameters of the counterweight 30 and pistons 15 and 29. The relative diameter between these elements are set for basic mechanical integrity and the strokes of the piston and counterweight must be equal for best spring life. Finally, the masses of these two elements also must be equal so that balance is achieved by their equal and opposite momentums.

Figure 3:
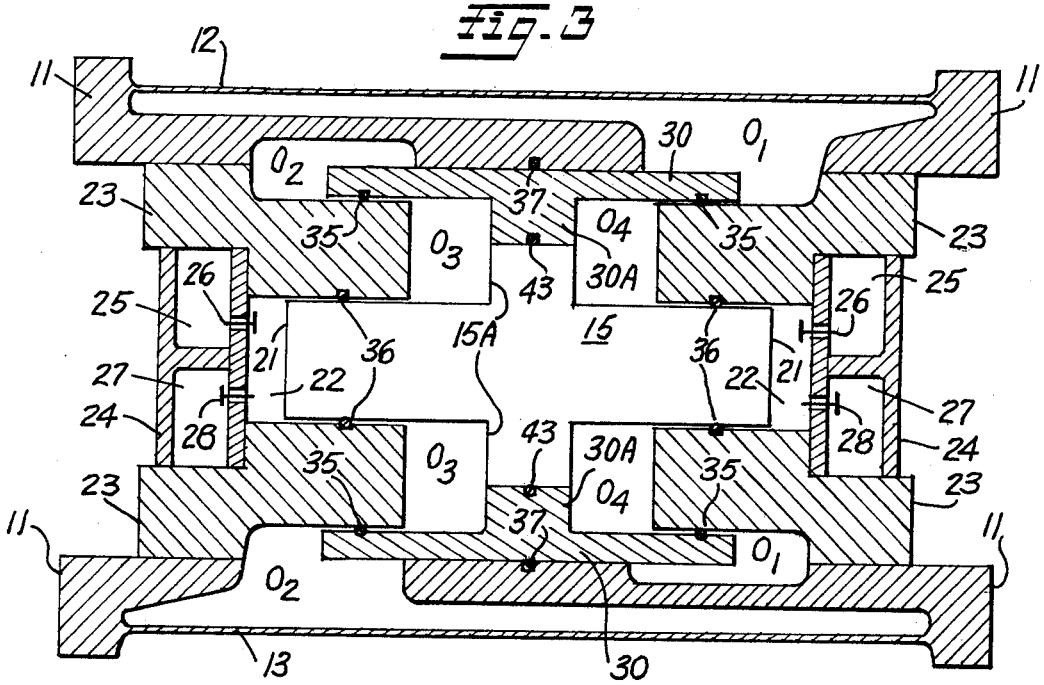
FIG. 3 is a schematic longitudinal sectional view of a different and preferred embodiment of a dynamically balanced, hydraulically driven compressor/pump apparatus for use with RFPSE according to the invention.

FIG. 3 is a schematic longitudinal sectional view of an improved, modified form of dynamically balanced, hydraulically driven compressor/pump apparatus according to the invention which provides for reduced size, mass and volume as well as complexity (part count) and hydraulic loss. In FIG. 3, like parts to those shown in FIGS. 1 and 2 have been identified with the same reference character. The design shown in FIG. 3 is such as to provide indirect coupling to the main piston 15 via the enlarged diameter annular portions of the main piston 15 which is seated in and rides within cylinder sleeves or liners 23 disposed within the transverse bore 14 that extends transversely across the entire width of the apparatus housing 11. Sleeves 23 and main piston 15 in conjunction with the housing casing 11 and counterweight 30 define the following volumetric spaces which are filled with an incompressible hydraulic fluid (oil) in the same manner as the embodiment of the invention shown in FIGS. 1 and 2. These volumetric spaces are identified as follows:

$O_1$ - first power diaphragm direct driven fixed oil volume communicating between the first power coupling flexible diaphragm 12 and one end of the annular counterweight 30

$O_2$ - second gas spring diaphragm driven fixed oil volume communicating between the second gas spring flexible diaphragm 13 and the opposite end of the annular counterweight 30

$O_3$ - first indirect driven fixed oil volume annularly surrounding main piston 15 and communicating between the enlarged diameter annular portion 15A of main piston 15 and the lesser diameter annular portion 30A of the annular counterweight 30

$O_4$ - second indirect driven fixed oil volume intercoupling the opposite side of the larger diameter portion 15A of main piston 15 and the corresponding side of the lesser diameter portion 30A of the annular counterweight 30

In the above briefly described simplified construction, a high differential pressure seal can be provided at 35 between the sleeve 34 and the overlying portions of the annular counterweight 30. An oil to gas seal is then provided at 36 between the main piston 15 and the internal diameter surface of sleeve 34. A driving pressure seal must be provided at 37 between the external diameter of the annular counterweight 30 and the surface of the bore or cylinder 14. A main piston driving seal shown at 43 must be provided between the internal surface of the lesser diameter portion 30A of counterweight 30 and the external surfaces of the larger diameter portion 15A of reciprocally movable piston 15. The apparatus is completed by the compressor plenums 24 which close the ends of the sleeves 23 seated in transverse bore or cylinder 14. The compressor plenum 24 includes the inlet plenum chambers 25 and inlet valves 26 and discharge plenum chamber 27 and discharge valves 28 for ingesting, compressing in compression space 22 and discharging compressed gas to the discharge plenum 27.

During operation, flexure in the inward direction of the power coupling first diaphragm 12 due to the periodic pressure wave produced by the RFPSE produces a pressure wave in the oil in chamber $O_1$ causing it to move the counterweight 30 leftward from the position shown. While thus moving the inner diameter surface portion of the counterweight at the sealing surface 43 slides along the outer diameter surface of the enlarged diameter portion 15A of main piston member 15. This movement tends to enlarge fixed volumetric space $O_4$ and produces a pressure wave in the oil in fixed volumetric space $O_3$. As a result, the main piston member 15 is driven to the right from the position shown in FIG. 3. Simultaneously, movement of the counterweight 30 to the left produces a pressure wave in the oil in chamber $O_2$ thereby causing the gas spring flexible diaphragm 13 to be flexed outwardly in the same axial direction as the inward deflection of the power coupling diaphragm 12 which initiates the cycle of reciprocation. During the succeeding lower pressure phase of the RFPSE periodic pressure wave, the gas spring flexible diaphragm 13 through the action of the gas spring and its own built-in spring action, will produce a pressure wave in the oil in the chamber $O_2$ so that it causes the counterweight 30 to be moved back to the right to its initial at rest position. Movement of the counterweight 30 back to the right will tend to enlarge fixed volumetric space $O_3$ and to produce a pressure wave in the oil in fixed volumetric space $O_4$ thereby driving main piston 15 back to the left to return the piston to its initial starting position and completing ½ cycle of reciprocation. This reciprocating action is then repeated at the frequency of the periodic pressure wave produced by the Stirling engine coupled to the power coupling first flexible diaphragm 12. Reciprocation of the air compressor piston 21 occurs simultaneously with the reciprocation of the main piston member 15 so as to repetitively ingest, compress and discharge the gaseous atmosphere being compressed in compression spaces 22 into the discharge plenum 27 in a well known manner.

Figure 4A:
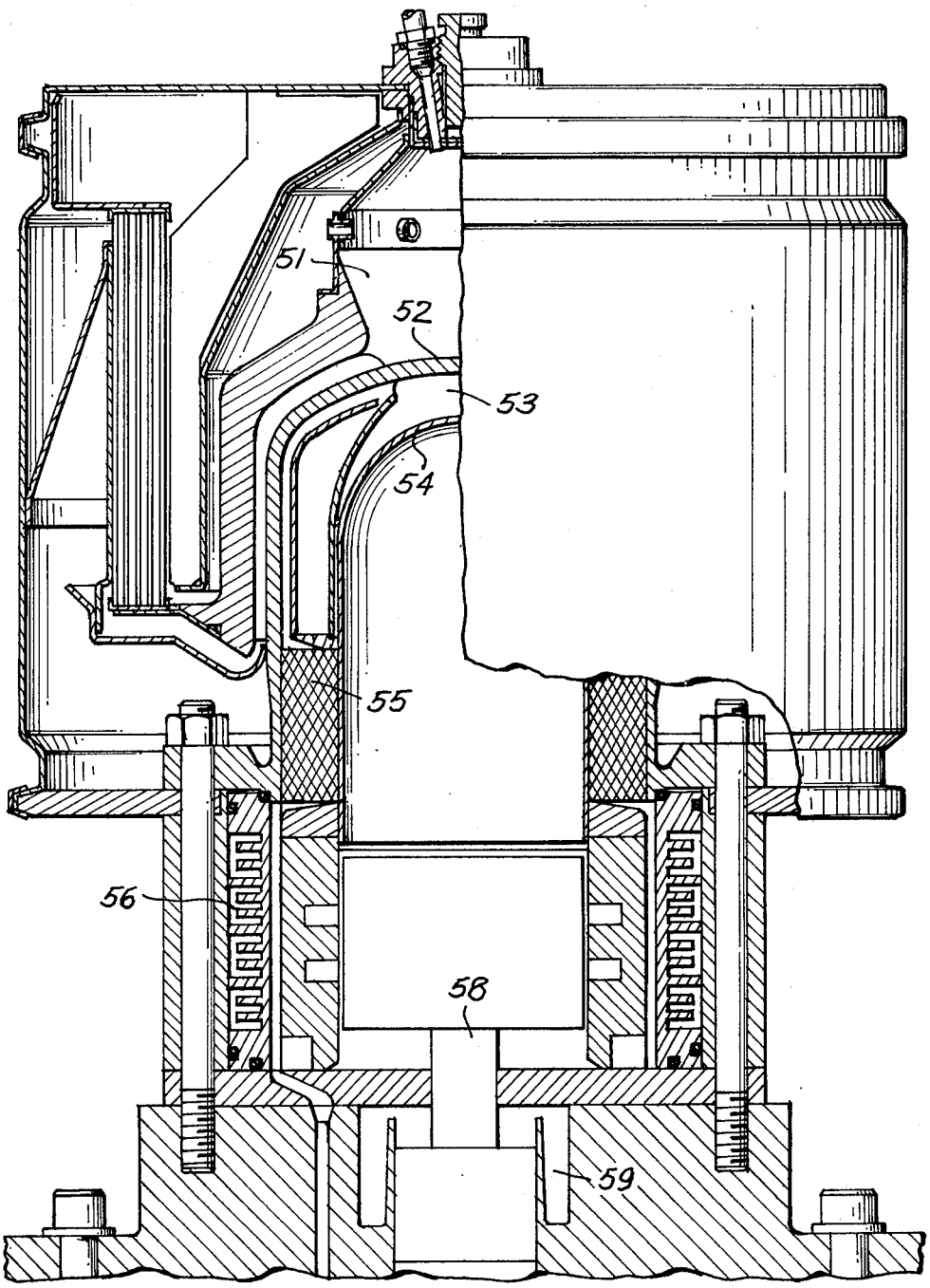
FIGS. 4A and 4B are a longitudinal sectional view of the physical details of construction of a complete power pack assembly including resonant free piston Stirling engine coupled through a power coupling flexible diaphragm to a preferred form of dynamically balanced, hydraulically driven compressor/pump apparatus constructed according to the invention and shown schematically in FIG. 3.
Figure 4B:
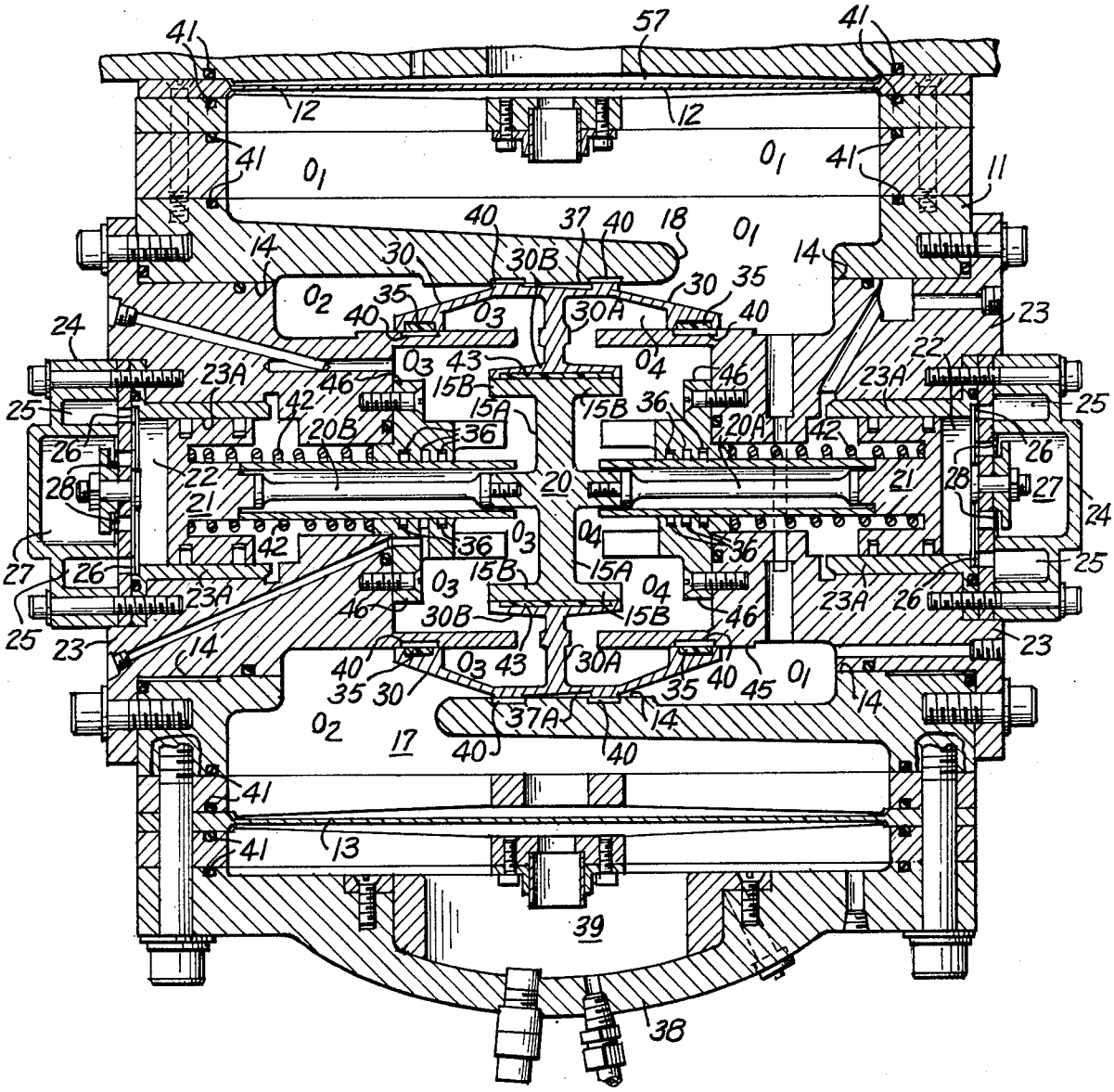

FIG. 4 is a detailed, longitudinal sectional view of the physical construction of a dynamically balanced, hydraulically driven gas compressor constructed according to the schematic illustration shown and described with relation to FIG. 3 in the preceeding paragraphs. In FIG. 4, which is a preferred embodiment of the invention, the dynamically balanced, hydraulically driven gas compressor shown employs the same reference numerals as were used in describing the schematic illustration of the same embodiment shown in FIG. 3. Hence, it is believed unnecessary to repeat the construction and operation in detail, but instead only point out differences in construction not embodied in the FIG. 3 illustration. The most important difference in features of construction of the FIG. 4 embodiment over that illustrated in FIG. 3, is in the construction of the main drive reciprocally movable piston member 15. In FIG. 4, piston member 15 includes a central web portion 15A secured to the shaft 20 and having an outward, enlarged diameter rim portion 15B. The balancing counterweight 30 in turn has a coacting annularly shaped inner rim portion 30B which reciprocates in a direction opposite from direction of movement of the rim portion 15A of piston 15 and includes a driving pressure seal 43 therebetween. The inner annular rim portion 30B is connected by a web portion 30A to the outer main body portion of the counterweight 30. This outer main body portion of counterweight 30 has outwardly extending skirts which seat upon and reciprocate relative to an outer bearing surface 45 formed around the inner ends of the flanged insert or liner 23. The driving pressure seals 35 are interposed between the outer skirt ends of counterweight 30 and surfaces 45 of liner 23. The right and left extensions 20A and 20B of shaft 20 are secured to and drive the compressor pistons 21 in much the same manner as the FIG. 2 embodiment of the invention. Mechanical centering springs 42 are positioned between the compressor pistons 21 and a housing 46 for the high differential pressure seals 36 secured to the inner end of the flanged liner insert 23 by suitable machine screws.

FIG. 4 also illustrates the overall assembly of a resonant free piston Stirling engine driving a dynamically balanced, hydraulically driven gas compressor according to the invention. The RFPSE includes a combustor 51 for heating a working fluid contained within a vessel 52 that defines an expansion space 53 into which a displacer 54 reciprocates. The expansion space 53 communicates through suitable fluid passageways (not shown) via a regenerator 55 and cooler 56 with a compression space 57 at the opposite end of the Stirling engine housing from the expansion space 53. The displacer 54 is connected to and drives a displacer rod 58 having skirts attached thereto which define gas spring volumes such as 59 which help to spring the displacer 54 within the space defined by the heating vessel 52 between compression space 57 and expansion space 53.

For a more detailed description of the construction and operation of the Stirling engine, reference is made to U.S. patent application Ser. No. 172,373, filed July 25, 1980—John J. Dineen, et. al.—Inventors, entitled, "Diaphragm Displacer Stirling Engine Powered Alternator-Compressor," now U.S. Pat. No. 4,380,152, assigned to Mechanical Technology Incorporated. However, for the purpose of this disclosure, briefly it can be stated that the combustor 51 heats the working gas (helium) which is trapped within the expansion space 53 between displacer 54 and vessel 52 supplying hot gases of combustion that flow around the exterior of the heating vessel 52 and then are exhausted back out through suitable exhaust ports (not shown) continuously during operation of the engine. The hot combustion gases thus supplied cause the working gas in expansion space 53 to be heated and expanded. The heat is added continually to the working gas through heat exchanger passages on vessel 52. As the gas is heated it causes a small increase in the internal engine pressure. This pressure increase cause both distension of the diaphragm 12 and a downward force on the displacer 54 due to an imbalance between the areas exposed to the expansion space 53 and the compression space 57. The force on the displacer 54 causes downward motion which moves the compressed cold gas from the compression space 57 through the connecting passages and elements into the expansion space 53 further increasing pressure. When most of the gas is in the expansion space and maximum expansion has occurred the pressure drops slightly. The energy stored in the displacer springs 59 causes it to move upwardly, shuttling gas from the expansion space through the regenerator and cooler to the compression space. As the gas is cooled pressure drops further causing the displacer to move further into the expansion space until nearly all the gas has been moved into the compression space. There the energy stored in the compression spring 39 recompresses the gas and the cycle begins anew.

The previously meantime pressure wave in the oil in space $O_1$, acts on counterweight 30 causing it to move leftward from the position shown and producing a pressure wave in the oil in space $O_2$. This in turn causes the second gas spring flexible diaphragm 13 to be flexed downwardly and compress gas within the gas spring volume 39.

The periodic heating and cooling of the working gas in the working spaces of the Stirling engine as briefly described above produces a periodic pressure wave in the compression space 57 which acts upon the first power coupling flexible diaphragm 12 in the above-described manner to cause it to flex downwardly periodically and to produce a pressure wave in the hydraulic oil in the space $O_1$. This then causes the counterweight 30 to move leftward from its position shown to increase pressure of the oil in space $O_2$ and flex gas spring diaphragm 13 downwardly as described briefly above. Simultaneously, movement of the counterweight 30 tends to alter the equal pressure condition of the oil in the additional fixed volume spaces $O_3$ and $O_4$ so as to produce a pressure wave in the oil in $O_3$ and increase the volume of $O_4$. To offset this tendency, the main drive piston 15 is moved to the right from its position shown thereby maintaining the constant volumetric relationship and causing the compressor pistons 21 to be moved to the right along with it. During the cyclic depressurization or relaxation of pressure in the compression space 57, gas spring diaphragm 13 and main drive coupling diaphragm 12 are returned back toward and through its center position, thereby moving counterweight 30 back to the right and producing a pressure wave in the oil in constant volume space $O_4$ to move the main drive piston 15 to the left from its position shown. This reciprocating movement is transmitted to the compression pistons 21 by shafts 20, 20A and 20B thereby causing them to reciprocate at the frequency of operation of the RFPSE and to ingest compress and discharge compressed gas out through the discharge plenum 27 of the assembly.

INDUSTRIAL APPLICABILITY

This invention relates to a dynamically balanced, hydraulically driven apparatus such as a gas compressor, pump, or other like apparatus driven by a resonant free piston Stirling heat engine for use in heat pump, heating, cooling and pumping applications and the like in locations where electricity is neither available or prohibitively expensive and the cost of conventional gasoline or diesel driven generator units makes their use impractical. The invention provides an improved compressor/pump apparatus which is compact, light, readily assembled and uses fewer components than prior art apparatus of the same type, and is designed to be mounted in driving relationship on a resonant free piston Stirling heat engine in an overall power pack assembly which is compact, easy and inexpensive to assemble and accessible for ready servicing when required.

Having described several embodiments of a new and improved dynamically balanced, hydraulically driven compressor/pump apparatus driven by a resonant free piston Stirling engine according to the invention, it is believed obvious that changes may be made in the particular embodiments of the invention described by those skilled in the art in the light of the above teachings. It is therefore to be understood that all such changes, additions and variations are believed to come within the full intended scope of the invention as defined by the appended claims.

What is claimed is:

1. Apparatus for use in conjunction with a periodically pressurized fluid drive source; said apparatus comprising a housing having a first side closed by a first flexible diaphragm designed to be exposed to the periodically pressurized fluid drive source and a second side opposite the first side closed by a second flexible diaphragm that comprises part of a gas spring, said housing having a bore extending therein which is transverse to the axial direction of movement of the first and second flexible diaphragms and forming a cylinder within the housing, a reciprocally movable piston disposed in said cylinder which reciprocally moves along an axis that is substantially at right angles relative to the direction of axial movement of the first and second flexible diaphragms, said cylinder having a first port formed therein comprising means for providing fluid drive coupling between a first side of the reciprocally movable piston and a first fixed volume space within the housing exposed to the first flexible diaphragm, a second port formed in said cylinder comprising means for providing fluid drive coupling between the second side of the reciprocally movable piston and a second fixed volume space formed within the housing exposed to the second flexible diaphragm, at least one working member of a compressor, pump or other like apparatus connected to and reciprocally driven by said reciprocally movable piston, an incompressible fluid filling the first and second spaces within the housing, and a counterweight disposed within said housing along with said reciprocally movable piston and which reciprocates within the housing in a direction opposite to the movement of the reciprocally movable piston for cancelling out vibrations otherwise induced by reciprocation of the piston.

2. An apparatus according to claim 1 further including additional fixed volume spaces filled with incompressible fluid acting on at least one side of the counterweight and on the reciprocally movable piston to cause one to move in a direction opposite to movement of the other.

3. An apparatus according to claim 2 wherein the reciprocally movable piston and cylinder arrangement is double acting and they are working members of a compressor, pump or other like apparatus connected to each side of the reciprocally movable piston and reciprocally driven thereby within the cylinder to provide a double acting apparatus.

4. An apparatus according to claim 3 further including mid-stroke ports arranged around said cylinder for equalizing the incompressible fluid in the volumetric spaces at substantially the mid-stroke position of the reciprocally movable piston.

5. An apparatus according to claim 4 further including mechanical centering springs effectively acting on said reciprocally movable piston for providing quasi-static centering of the piston over long periods of inactivity.

6. An apparatus according to claim 2 wherein each of said first and second spaces are divided respectively into a direct acting fixed volume space and an indirect acting fixed volume space by an annular counterweight member circumferentially surrounding and sealing slidable along the reciprocally movable piston to provide the additional fixed volume spaces, with the reciprocally movable piston and the annular counterweight member servinq to separate the two indirect acting fixed volume spaces, respectively, the incompressible fluid in the direct acting portion of the first fixed volume space acting on said annular counterweight member to move it in the first direction and an incompressible fluid within the direct acting portion of the second fixed volume space acting on the annular counterweight member to move it in a direction opposite to the first direction whereby the incompressible fluid contained in the indirect acting fixed volume portions of the first and second spaces are caused to act on the reciprocally movable piston to cause it to move in a direction opposite to movement of the annular counterweight member.

7. An apparatus according to claim 6 wherein the reciprocally movable piston and cylinder arrangement is double acting and they are working members of a compressor, pump or other like apparatus connected to each side of the reciprocally movable piston and reciprocally driven thereby within the cylinder to provide a double acting apparatus.

8. An apparatus according to claim 7 further including mid-stroke ports arranged around said cylinder for equalizing the incompressible fluid in the volumetric spaces at substantially the mid-stroke position of the reciprocally movable piston and including mechanical centering springs effectively acting on said reciprocally movable piston for providing quasi-static centering of the piston over long periods of inactivity.

9. An apparatus according to claim 8 wherein the working members reciprocally moved at each end of the cylinder by the reciprocally movable piston comprise the piston drive members of a compressor for compressible fluids with the inlet and discharge plenums for the compressible fluid being arranged over the open ends of the cylinders at each end thereof and communicating therewith through suitable valving means, and with the respective piston drive member of the double acting compressor thus comprised having suitable sliding seals for preventing leakage of the compressible fluid internally into and around the reciprocally movable piston thereby avoiding intermixture with the incompressible fluid used to drive the reciprocally movable piston.

10. An apparatus according to claim 2 wherein the incompressible fluid in the first space acts directly on one side of the reciprocally movable piston and the incompressible fluid in the second space acts directly on the opposite side of the reciprocally movable piston and wherein the counterweight comprises an annular counterweight member disposed within the cylinder and circumferentially surrounding a partition member secured to and movable with a connecting rod connecting the reciprocally movable piston to the working member of the apparatus with said slidable partition dividing a portion of the interior of the cylinder axially spaced from the reciprocally movable piston into additional fixed volume spaces also filled with an incompressible fluid, the additional fixed volume spaces communicating with opposite sides of the annular counterweight member for causing the annular counterweight member to be moved in a direction opposite to the direction of movement of the reciprocally movable piston.

11. An apparatus according to claim 10 wherein the reciprocally movable piston and cylinder arrangement is double acting and there are working members of a compressor, pump or other like apparatus connected to each side of the reciprocally movable piston and reciprocally driven thereby within the cylinder to provide a double acting apparatus.

12. An apparatus according to claim 11 further including mid-stroke ports arranged around said cylinder for equalizing the incompressible fluid in the volumetric spaces at substantially the mid-stroke position of the reciprocally movable piston and including mechanical centering springs effectively acting on said reciprocally movable piston for providing quasi-static centering of the piston over long periods of inactivity.

13. An apparatus according to claim 12 wherein the working members reciprocally moved at each end of the cylinder by the reciprocally movable piston comprise the piston drive members of a compressor for compressible fluids with the inlet and discharge plenums for the compressible fluid being arranged over the open ends of the cylinders at each end thereof and communicating therewith through suitable valving means, and with the respective piston drive member of the double acting compressor thus comprised having suitable sliding seals for preventing leakage of the compressible fluid internally into and around the reciprocally movable piston thereby avoiding intermixture with the incompressible fluid used to drive the reciprocally movable piston.

14. A combination heat driven resonant free piston Stirling engine and compressor, pump, alternator or other like apparatus comprising a Stirling engine having a combustor for heating a working fluid within an expansion chamber, a displacer reciprocally movable into the expansion chamber, a regenerator, a cooler, a compression space and fluid passageways interconnecting the expansion chamber with the compression space via the regenerator and cooler, said displacer serving to shuttle the working fluid back and forth between the expansion chamber and the compression space via the regenerator and cooler to develop a periodic pressure wave within the compression space, a power coupling flexible diaphragm closing the compression space; and a compressor, pump or other like apparatus coupled to and driven by said Stirling engine comprising a housing having a first side closed by said power coupling flexible diaphragm which is exposed to the periodic pressure wave produced by said Stirling engine and a second side opposite the first side closed by a second flexible diaphragm that comprises part of a gas spring, said housing having a bore extending therein which is transverse to the axial direction of movement of the power coupling and second flexible diaphragms and forming a cylinder within the housing, a reciprocally movable piston disposed in said cylinder which reciprocally moves along an axis that is substantially at a right angle relative to the direction of axial movement of the power coupling and second flexible diaphragms, said cylinder having a first port formed therein comprising means for providing fluid drive coupling between a first side of said reciprocally movable piston and a first fixed volume space within the housing exposed to the power coupling flexible diaphragm, a second port formed in the cylinder comprising means for providing fluid drive coupling between the second side of the reciprocally movable piston and a second fixed volume space formed within the housing and exposed to the second flexible diaphragm, at least one working member of a compressor, pump, alternator or other like apparatus reciprocally movable within the cylinder and connected to and driven by the reciprocally movable piston, an incompressible fluid filling the first and second spaces within the housing, a counterweight disposed within said housing along with said reciprocally movable piston and which reciprocates within the housing in a direction opposite to the movement of the reciprocally movable piston for cancelling out vibrations otherwise induced by reciprocation of the piston, and additional fixed volume spaces filled with incompressible fluid on at least one side of the counterweight and the reciprocally movable piston for coacting with reciprocal movement of the reciprocally movable piston to cause the counterweight to move in a direction opposite to movement of the reciprocally movable piston.

15. An apparatus according to claim 14 wherein the reciprocally movable piston and cylinder arrangement is double acting and further includes working members of a compressor, pump, alternator or other like apparatus connected to each side of the reciprocally movable piston and reciprocally driven thereby within the cylinder to provide a double acting apparatus.

16. An apparatus according to claim 15 further including mid-stroke ports arranged around said cylinder for equalizing the incompressible fluid in the volumetric spaces at substantially the mid-stroke position of the reciprocally movable piston and mechanical centering springs effectively acting on said reciprocally movable piston for providing quasi-static centering of the piston over long periods of inactivity.

17. An apparatus according to claim 16 wherein each of said first and second spaces are divided respectively into a direct acting fixed volume space and an indirect acting fixed volume space by an annular counterweight member circumferentially surrounding and sealing slidable along the reciprocally movable piston to provide the additional fixed volume spaces with the reciprocally movable piston and the annular counterweight member serving to separate the two indirect acting fixed volume spaces, respectively, the incompressible fluid in the direct acting fixed volume portion of the first fixed volume space acting on said annular counterweight member to move it in the first direction and the incompressible fluid within the direct acting fixed volume portion of the second space acting on the annular counterweight member to move it in a direction opposite to the first direction whereby the incompressible fluid contained in the indirect acting fixed volume portions of the first and second spaces acts on the reciprocally movable piston to move it in a direction opposite to movement of the annular counterweight member.

18. An apparatus according the claim 16 wherein the incompressible fluid in the first space acts directly on one side of the reciprocally moveable piston and the incompressible fluid in the second space acts directly on the opposite side of the reciprocally moveable piston, and wherein the counterweight comprises an annular counterweight member disposed within the cylinder and circumferentially surrounding a slidable partition secured to and movable with the connecting rod connecting the movable member to the working member of the apparatus with said slidable partition dividing a portion of the interior of the cylinder axially spaced from the reciprocally movable piston into at least one additional constant volume spaces also filled with an incompressible fluid, the additional constant volume spaces communicating with opposite sides of the annular counterweight member for moving the counterweight member in a direction opposite to the direction of movement of the reciprocally movable piston.

19. An apparatus according to either claim 17 or claim 18 wherein the working members reciprocatingly moved at each end of a cylinder by the reciprocally movable piston comprise the piston members of a compressor for compressible fluids with the inlet and discharge plenums for the compressible fluid being arranged over the open ends of the cylinders at each end thereof and communicating therewith through suitable valving means, and with the respective piston member of the double acting compressor thus comprised having suitable sliding seals for preventing leakage of the compressible fluid internally into and around the reciprocally movable piston thereby avoiding intermixture with the incompressible fluid used to drive the reciprocally movable piston.

20. The method of operating a resonant free piston Stirling engine driven compressor, pump or other like apparatus wherein the compressor/pump apparatus comprises a housing having a first side closed by a power coupling flexible diaphragm driven by the resonant free piston Stirling engine and a second side opposite the first side closed by a second flexible diaphragm that comprises part of a gas spring, the housing having a central bore therein which forms a cylinder that extends transversely through the housing in a direction at right angles to the axial direction of the flexure of the flexible diaphragms, a reciprocally movable piston slidably seated in the cylinder, an incompressible fluid filling space formed in the housing which is divided into two separate chambers that provide effective fluid coupling between the power coupling flexible diaphragm and one side of the reciprocally movable piston and between the second gas spring flexible diaphragm and the remaining opposite side of the reciprocally movable piston, respectively, and at least one working member of a compressor, pump or other like apparatus connected to and reciprocally driven within said cylinder by the reciprocally movable piston; said method comprising driving the reciprocally movable piston and its interconnected working member in a first direction within the cylinder via the incompressible fluid coupling upon flexure of the resonant free piston Stirling engine driven power coupling flexible diaphragm in a second direction which is at substantially right angles to the first direction of movement of the reciprocally movable piston to thereby cause flexure of the gas spring flexible diaphragm in the same second direction due to incompressible fluid coupling in the second chamber and movement of the reciprocally movable piston, said Stirling engine driven and gas spring flexible diaphragms being returned in a direction opposite to the second direction back toward the position of the diaphragm by spring return action induced by their flexure upon the cyclical reduction in pressure of the periodic pressure wave produced by the resonant free piston Stirling engine to thereby drive the reciprocally movable piston and its interconnected working member via incompressible fluid coupling in the second and first chambers back in a direction opposite to the first direction to thereby reciprocate the movable piston and its interconnected working member within the cylinder at same frequency as the frequency of the periodic pressure wave produced by the resonant free piston Stirling engine but along an axial direction of movement which is substantially at right angles to the axial direction of the applied force developed by the periodic pressure wave produced by the resonant free piston Stirling engine, and counterbalancing the vibrations produced by reciprocation of the reciprocally movable piston.

21. The method according to claim 20 wherein the apparatus is double acting and has working members formed in each end of the cylinder for producing output work during each stroke of the reciprocally movable piston.

22. The method according to claim 20 wherein counterbalancing is achieved with a counterbalance weight member driven by incompressible fluid coupling acting on opposite ends of said counterbalance weight member via at least one additional fixed volume space filled with the incompressible fluid.

23. The method according to claim 22 wherein the apparatus is double acting and has working members formed in each end of the cylinder for producing output work during each stroke of the reciprocally movable piston.

24. The method according to claim 23 wherein the incompressible fluid in the one or more additional fixed volume spaces is equalized at substantially the mid-stroke position of the reciprocally movable piston.

25. The method according to claim 24 wherein the reciprocally movable piston and interconnecting working members are effectively centered in the housing over the long periods of inactivity by mechanical centering springs effectively acting on the reciprocally movable piston and the counterbalance weight.

26. The method according to claim 25 wherein the fluid pressure produced by flexure of the power coupling flexible diaphragm acts on the annular counterweight member to cause the incompressible fluid in the one or more additional fixed volume spaces to drive the reciprocally movable piston in one direction opposite to movement of one annular counterweight member and the fluid pressure induced by return spring action of the second flexible diaphragm comprising a part of the gas spring acts on the annular counterweight member in the opposite direction to return it in the opposite direction and to cause the incompressible fluid in the one or more additional fixed volume spaces to drive the reciprocally movable piston in the return direction.

27. The method according to claim 25 wherein the incompressible fluid pressure produced by flexure of the power coupling flexible diaphragm acts directly on one side of the reciprocally movable piston to move it in one direction and movement of the reciprocally movable piston acts through the incompressible fluid in the one or more additional fixed volume spaces to drive the annular counterweight member in the opposite direction to movement of the reciprocally movable piston, and the fluid pressure of the incompressible fluid produced by the return spring action of the second flexible diaphragm comprising a part of the gas spring, acts directly on the opposite side of the reciprocally movable piston to return it in the opposite direction and to cause the incompressible fluid in the one or more additional fixed volume spaces to drive the annular counterweight member back in its return direction during each reciprocating cycle of operation of the apparatus.

* * * * *